US005389941A

United States Patent [19]

Yu

[11] Patent Number: 5,389,941

[45] Date of Patent: Feb. 14, 1995

[54] DATA LINK ANTENNA SYSTEM

[75] Inventor: I-Ping Yu, Thousand Oaks, Calif.

[73] Assignee: Hughes Aircraft Company, Los Angeles, Calif.

[21] Appl. No.: 843,134

[22] Filed: Feb. 28, 1992

[51] Int. Cl.[6] ..... H01Q 21/26

[52] U.S. Cl. ..... 343/797; 343/840; 343/853

[58] Field of Search ..... 343/797, 798, 799, 800, 343/832, 840

[56] References Cited

U.S. PATENT DOCUMENTS

| | | | |
|---|---|---|---|
| 2,413,187 | 12/1946 | McCurdy et al. | 343/840 |
| 2,462,881 | 3/1949 | Marchetti | 343/814 |
| 2,480,182 | 9/1949 | Clapp | 343/798 |
| 2,512,147 | 6/1950 | Gardner | 343/840 |
| 3,196,443 | 7/1965 | Martin | 343/797 |
| 3,541,559 | 4/1968 | Evans | 343/798 |
| 3,747,116 | 7/1973 | Milam | 343/840 |
| 3,922,683 | 11/1975 | Kumpebeck | 343/797 |
| 4,005,433 | 1/1977 | Tsuda | 343/819 |
| 4,090,203 | 5/1978 | Duncan | 343/840 |
| 4,101,901 | 7/1978 | Kommrusch | 343/853 |
| 4,109,254 | 8/1978 | Woloszczuk | 343/797 |
| 4,123,759 | 10/1978 | Hines et al. | 343/854 |
| 4,160,980 | 7/1979 | Murray | 343/840 |
| 4,516,133 | 5/1985 | Matsumoto et al. | 343/840 |
| 4,982,198 | 1/1991 | Sajai et al. | 343/818 |
| 5,091,732 | 2/1992 | Mileski et al. | 343/797 |

FOREIGN PATENT DOCUMENTS

| | | | |
|---|---|---|---|
| 2400782 | 3/1979 | France . | |
| 2052875 | 1/1981 | United Kingdom | 343/797 |

*Primary Examiner*—Donald Hajec
*Assistant Examiner*—Tan Ho
*Attorney, Agent, or Firm*—Charles D. Brown; Randall M. Heald; Wanda K. Denson-Low

[57] ABSTRACT

An antenna employs the back radiation of a crossed-dipole to illuminate a parabolic cylindrical reflector. The crossed dipole is supported by a feed network mast which simplifies the feed network and eliminates the need for other supporting structure and its electrical blockage. To form an antenna system having omni-directional radiation coverage, four of these antennas are located at the four quadrants, each covering one quadrant in the azimuth direction. The RF signal is fed through a single pole four throw switch to the selected antenna to be radiated to the desired direction.

21 Claims, 4 Drawing Sheets

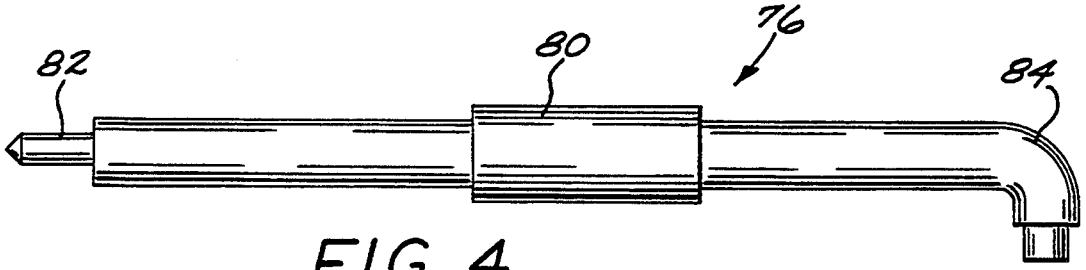
FIG. 4
FIG. 5
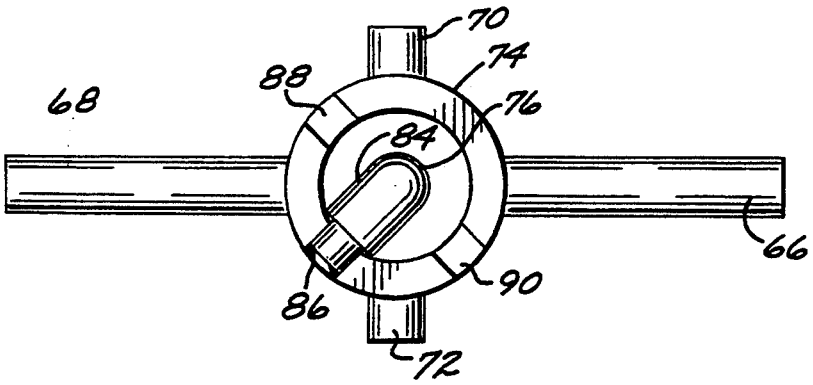
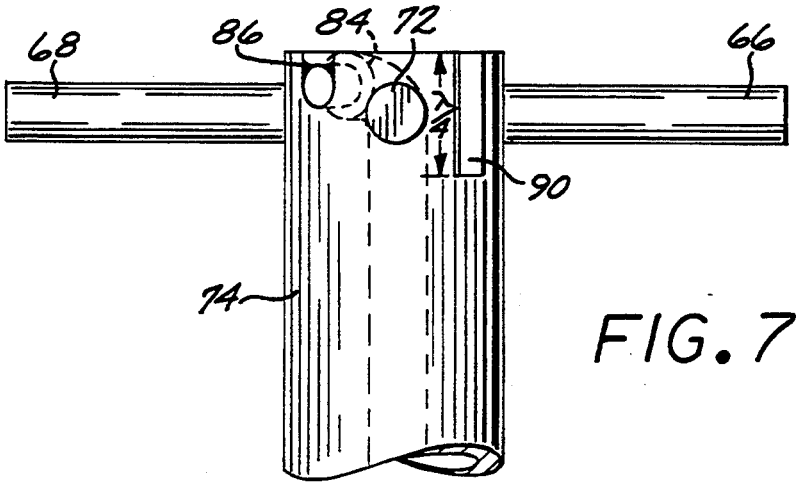
FIG. 7

DATA LINK ANTENNA SYSTEM

BACKGROUND OF THE INVENTION

The present invention relates to a simple parabolic reflector antenna and to omnidirectional antenna systems.

Conventional parabolic reflector antennas include the reflector, the primary energy source such as a feed horn, and the feed network for feeding the RF energy to the primary source. Such antennas also require supporting structure to suspend the feed horn and feed network in proper position relative to the reflector surface.

For some applications of antenna systems, space and weight requirements impose severe restrictions on the antenna system. One such application is that of data link antenna systems used in a communication uplink from the ground to airborne missiles. Such antenna systems are typically mounted on a ground vehicle, and must meet very stringent weight and power requirements.

It would therefore present an advance in the art to provide a simplified parabolic reflector antenna which is relatively light in weight and efficient.

It would also be advantageous to provide an omnidirectional antenna system employing simple and weight-efficient parabolic antennas.

SUMMARY OF THE INVENTION

In accordance with one aspect of the present invention, an antenna is disclosed which includes a parabolic cylindrical reflector surface and a crossed-dipole structure arranged such that the back radiation of the crossed-dipole illuminates said reflector surface. Means are provided for supporting the cross-dipole structure above the reflector surface and for feeding an exciting RF signal to the crossed-dipole structure. This supporting and feeding means includes an electrically conductive hollow support mast extending from the reflector surface and to which the crossed-dipole structure is attached, and a center conductor element which extends through the hollow support mast to define a coaxial transmission line for feeding RF energy to the crossed-dipole. The crossed dipole is located at the vicinity of the focus of the reflector.

The mast is further characterized by a first end disposed above the reflector surface and to which the crossed-dipole is attached. The center conductor element is further characterized by an elongated body and by first and second ends. The first end terminates in a tip defining an angle with respect to the elongated body, the tip being electrically connected to the mast at the first end thereof. Two quarter-wavelength chokes are defined in the first end of the mast to provide electrical isolation between the center conductor tip and two dipole elements of the structure.

In accordance with another aspect of the invention, an antenna system having omni-directional radiation coverage is provided, wherein a plurality of cross-dipole antennas are disposed to illuminate respective sectors relative to the desired radiation coverage. The antenna system further includes means for selectively coupling an RF drive signal to a selected one of the antennas to radiate the RF signal to the desired sector.

In a preferred embodiment, four of the crossed-dipole antennas are disposed at respective quadrant positions in order to selectively radiate energy to a desired quadrant of the radiation coverage. An RF switch can be used as the selective coupling means.

BRIEF DESCRIPTION OF THE DRAWING

These and other features and advantages of the present invention will become more apparent from the following detailed description of an exemplary embodiment thereof, as illustrated in the accompanying drawings, in which:

FIG. 4 illustrates the center conductor of the antenna of FIG. 2.

FIG. 5 is a top view of the dipole elements and adjacent feed circuitry of the antenna of FIG. 2.

FIG. 7 is a side view of the top portion of the feed network element of the antenna of FIG. 2.

DETAILED DESCRIPTION OF THE PREFERRED EMBODIMENT

One aspect of the present invention is in an antenna which comprises a parabolic cylindrical reflector illuminated by the back radiation of a crossed-dipole. This reflector shape will form a wide radiation pattern in the azimuth direction and a narrow radiation pattern in the elevation direction. Another aspect of the invention is in an antenna system comprising four of these antennas located at the four quadrants, wherein each covers one quadrant in the azimuth direction. The antenna system further comprises a single pole four throw switch (SP4T switch). The RF signal passes through the SP4T switch to the selected quadrant antenna, to radiate the signal to the desired direction to link with a target vehicle.

Figure 1:
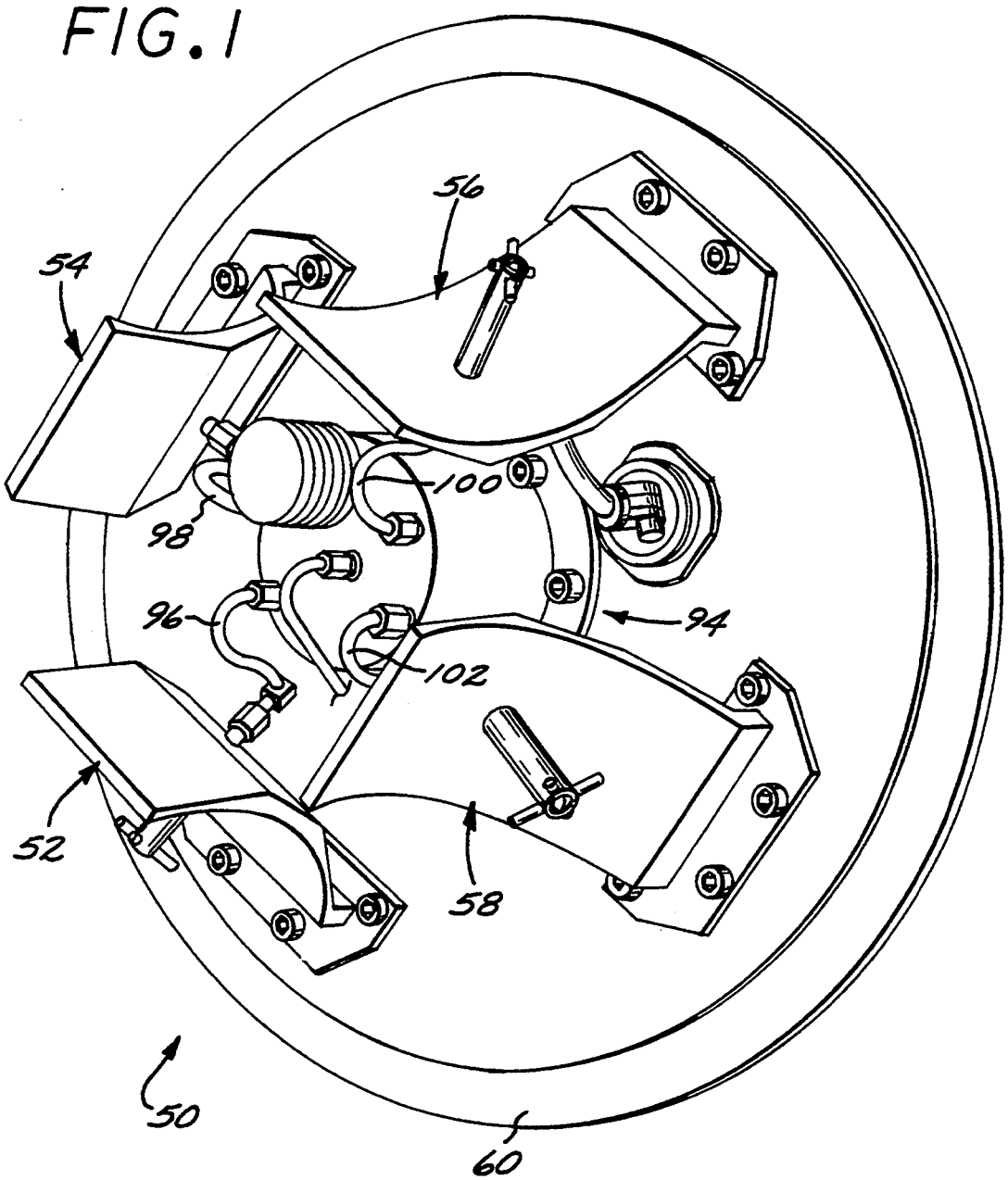
FIG. 1 is a perspective view of an omnidirectional parabolic reflector antenna system embodying the invention.

An exemplary omnidirectional antenna system 50 in accordance with the invention is illustrated in FIG. 1. Four antennas 52, 54, 56 and 58 are mounted on an antenna system support plate 60 at 90 degree spacings. Each antenna comprises a parabolic cylinder reflector and a crossed-dipole antenna arranged to illuminate the reflector with circularly polarized radiation.

Figure 2:
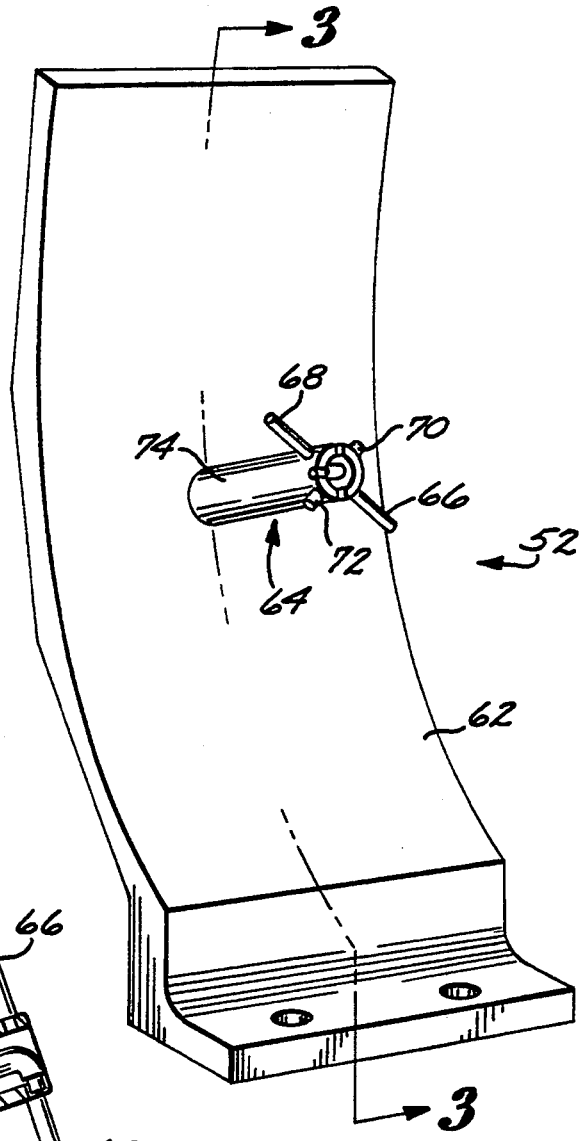
FIG. 2 is a perspective view of one of the parabolic antennas comprising the antenna system of FIG. 1.

Exemplary antenna 52 is shown in a close-up perspective view in FIG. 2. The antenna comprises the reflector 62 and the crossed-dipole 64 extending perpendicularly to the center of the reflector surface. The dipole includes opposed long arm elements 66 and 68, and opposed short arm elements 70 and 72 disposed at right angles relative to the long arm elements. Both the long and short arm elements are supported on a dipole support mast and feed network member 74.

Figure 3:
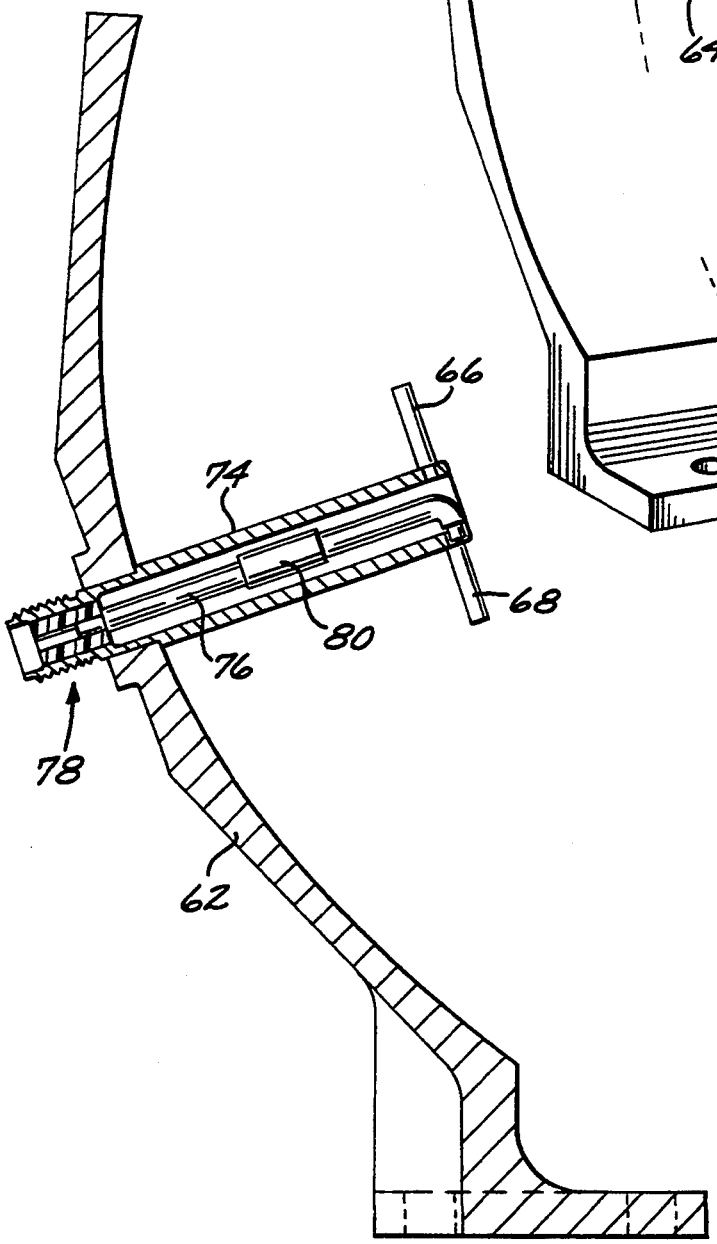
FIG. 3 is a side cross-sectional view of the antenna of FIG. 2.

The cross-sectional view of FIG. 3 shows the assembly of the dipole mast and center conductor 76. The dipole feed network 74 is a hollow conductive tube element, which operates as the outer conductor of a coaxial transmission line. The center conductor 76 is fitted within the feed network element 74 and extends from a coaxial connector fitting 78 to the exposed tip of the network 74. The center conductor 76 is a solid conductive element, and the diameter of the conductor is increased at an area intermediate the exposed tip and the connector 78 to form an impedance transformer section 80.

FIG. 4 shows the center conductor 76 in further detail. The end 82 is for fitting into the connector fitting 78. The end 84 terminates in a rounded tip bent at a 90 degree angle with respect to the body of the center conductor. The tip of the end 84 is soldered to the side of the feed network element 74, as shown in FIG. 5. The impedance transformer section 80 is one-quarter wavelength (with respect to the center of the frequency band) in length, and the conductor diameter is sized to provide an impedance of 37.5 ohms in this embodiment, to transform between the 50 ohm characteristic impedance of the coaxial connector 78 at one end of the coaxial line, and the 25 ohm impedance of the crossed-dipole at the other end of the coaxial line. As is well known in the art, the diameter of the center conductor is related to the characteristic impedance of the coaxial line in accordance with the relationship $(138/(\epsilon)^{\frac{1}{2}})[\log(D/d)]$, where $\epsilon$ represents the relative dielectric constant of the medium separating the center and outer conductors, d is the inner diameter of the outer conductor and D is the outer diameter of the center conductor.

Figure 6:
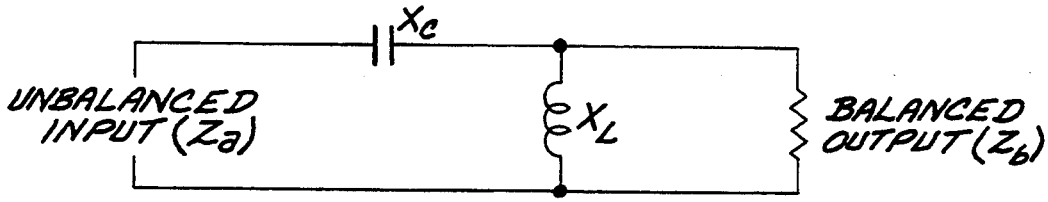
FIG. 6 illustrates the equivalent circuit of the balun arrangement used to feed the crossed dipole structure.

The tip of the network 74 is shown in further detail in FIGS. 5 and 7. The bent end 84 of the center conductor 76 is soldered to the tip of the network 74 at location 86 intermediate the long arm 68 and the short arm 72, i.e., at 45 degree spacing from each of these arms 68 and 72. Two quarter-wavelength chokes 88 and 90 (at the band center frequency) are formed in the network member 74 at the end thereof. Effectively, the side of the network 74 relative to the chokes to which the end 84 is soldered is the "center conductor" of a coaxial transmission line representation, and the inner side of the network 74 opposite the soldered end 84 acts as the "outer conductor." The quarter-wavelength chokes 88 and 90 at the band center frequency $f_o$ function as a balun to the unbalanced input (the "coaxial" transmission line) to the balanced output (the crossed dipoles). The equivalent circuit for the balun arrangement is shown in FIG. 6, where $X_c = -jZ_a \cot[\pi f/2f_o]$ and $X_L = -jZ_b \tan(\pi f/2f_o)$, $Z_a$ represents the unbalanced coaxial line impedance and $Z_b$ represents the balanced transmission line impedance.

FIG. 7 illustrates the choke 90, which is fabricated as a narrow notch formed in the network 74, to a depth of one quarter-wavelength at the center frequency $f_o$.

As is well known, for two orthogonal dipoles driven in parallel, the short arms of the crossed-dipole are shorter than one half wavelength at the resonant frequency of the antenna, and the long arms are somewhat longer than one half wavelength. The respective lengths of the dipole arms are chosen so that the magnitudes of their input impedances are equal, and the phase angle differs by 90°. The resulting cross-dipole structure will radiate circularly polarized electromagnetic radiation. If a linearly polarized antenna is needed for a particular application, a simple dipole can be used to illuminate the reflector.

Figure 8:
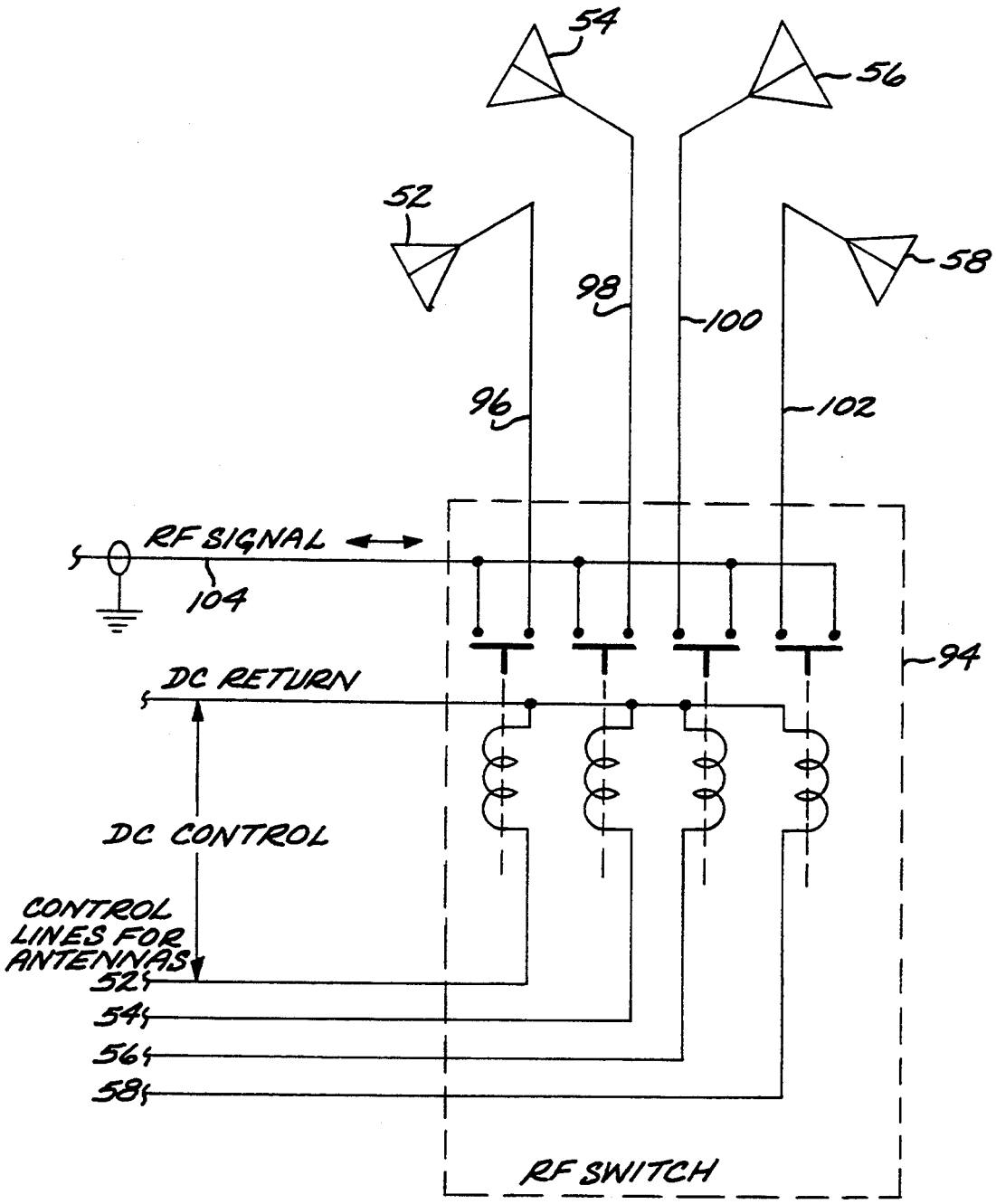
FIG. 8 is a simplified schematic diagram of the antenna system of FIG. 1.

FIG. 8 is a schematic diagram illustrating the operation of the omnidirectional antenna system 50. The respective antennas 52, 54, 56 and 58 are connected to the SP4T switch 94 via coaxial lines 96, 98, 100 and 102 connected to the respective connector fittings for each antenna. The RF signal input to the switch on line 104 can be switched to any of the four antennas 52, 54, 56 and 58 by appropriate control of the switch 94. The switch 94 is commercially available, e.g., the model 441C-530802 switch available from Dowkey Microwave Corporation, 1667 Walter Street, Ventura, Calif. 93003. Accordingly, the RF signal may be transmitted via any one of the four antennas, thereby achieving selectable omni-directional coverage.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An antenna system having omni-directional radiation coverage, comprising:

a plurality of antennas, each disposed to illuminate only a respective sector relative to a desired omni-directional radiation coverage;

means for selectively coupling an RF drive signal to only a selected one of said antennas to radiate said signal only to the sector illuminated by said selected antenna; and wherein each of said antennas comprises:

a parabolic cylindrical reflector surface characterized by a focus disposed above said surface;

a dipole structure arranged such that the back radiation of said dipole illuminates said reflector surface, the forward radiation of said dipole being free to radiate away from said surface without being redirected to said surface; and means for supporting said dipole structure above said surface for feeding said drive signal to said dipole structure, said supporting and feeding means comprising an electrically conductive hollow support mast extending from said surface and to which said dipole structure is attached, and a center conductor element which extends through said hollow support mast to define a coaxial transmission line.

2. The antenna system of claim 1 wherein said means for selectively coupling comprises an RF switch having an input port for receiving said RF drive signal, and a plurality of output ports, a respective one of said output ports being electrically coupled to a respective one of said antennas.

3. The antenna system of claim 2 wherein said antennas and said switch are secured to a base plate, and said output ports are connected to said respective antennas by a plurality of respective coaxial transmission lines.

4. The antenna system of claim 1 wherein said mast is further characterized by a first end disposed above said surface and to which said dipole structure is attached, and said center conductor element is further characterized by an elongated body and by first and second ends, said first end of said center conductor element terminating in a tip defining an angle with respect to said elongated body, said tip being electrically connected to said mast at said first end of said mast.

5. The antenna system of claim 1 further comprising a coaxial connector extending below said surface and to which said center conductor and said hollow support mast are connected, said coaxial connector comprising a means for connecting an RF drive source to said antenna.

6. An antenna system having omni-directional radiation coverage, comprising:

a plurality of antennas, each disposed to illuminate only a respective sector relative to the desired omni-directional radiation coverage;

means for selectively coupling an RF drive signal only to a selected one of said antennas to radiate said signal only to the sector illuminated by said selected antenna; and wherein each of said antennas comprises:

a parabolic cylindrical reflector surface characterized by a focus disposed above said surface;

a crossed-dipole structure arranged such that the back radiation of said crossed-dipole illuminates said reflector surface, the forward radiation of said crossed-dipole structure being free to radiate away from said surface without being redirected to said surface; and means for supporting said crossed-dipole structure above said surface and for feeding said drive signal to said crossed-dipole structure, said supporting and feeding means comprising an electrically conductive hollow support mast extending from said surface and to which said crossed-dipole structure is attached, and a center conductor element which extends through said hollow support mast to define a coaxial transmission line.

7. The antenna system of claim 6 wherein said means for selectively coupling comprises an RF switch having an input port for receiving said RF drive signal, and a plurality of output ports, a respective one of said output ports being electrically coupled to a respective one of said antennas.

8. The antenna system of claim 7 wherein said antennas and said switch are secured to a base plate, and said output ports are connected to said respective antennas by a plurality of respective coaxial transmission lines.

9. The antenna system of claim 6 wherein said mast is further characterized by a first end disposed above said surface and to which said crossed-dipole structure is attached, and said center conductor element is further characterized by an elongated body and by first and second ends, said first end of said center conductor element terminating in a tip defining an angle with respect to said elongated body, said tip being electrically connected to said mast at said first end of said mast.

10. The antenna system of claim 9 wherein said crossed-dipole structure is further characterized by a crossed-dipole resonant frequency, and comprises first and second opposed long arm elements each having a length greater than one half the wavelength of the crossed-dipole resonant frequency, and first and second opposed short arm elements arranged at quadrature to the long arm elements, said short arm elements having a length less than said one half wavelength, and wherein the lengths of said respective long and short arm elements are selected so that the respective input impedances of the short arm and long arm dipoles are substantially equal and the phase difference between the respective signals radiated by said respective dipoles is substantially 90°.

11. The antenna system of claim 10 further comprising first and second quarter-wavelength chokes defined in said first end of said mast, said chokes disposed opposite one another and intermediate respective ones of said long and short arm elements, said first choke disposed at a 90 degree spacing from said center conductor end tip.

12. The antenna system of claim 6 further comprising a coaxial connector extending below said surface and to which said center conductor and said hollow support mast are connected, said coaxial connector comprising a means for connecting an RF drive source to said antenna.

13. The antenna system of claim 6 wherein said crossed-dipole structure is arranged to radiate circularly polarized radiation.

14. An antenna system having omni-directional radiation coverage, comprising:

first, second, third and fourth quadrant sector antennas disposed in a circularly symmetric fashion at respective quadrants relative to the desired azimuth omnidirectional radiation coverage;

means for selectively coupling an RF drive signal only to a selected one of said antennas to radiate said signal only to a desired quadrant direction; and wherein each of said antennas comprises:

a parabolic cylindrical reflector surface;

a crossed-dipole structure arranged such that the back radiation of said crossed-dipole illuminates said reflector surface; and means for supporting said structure above said surface and for feeding said drive signal to said crossed-dipole structure, said supporting and feeding means comprising an electrically conductive hollow support mast extending from said surface and to which said crossed-dipole structure is attached, and a center conductor element which extends through said hollow support mast to define a coaxial transmission line.

15. The antenna system of claim 14 wherein said means for selectively coupling comprises a single pole four throw RF switch having an input port for receiving said RF drive signal, and first, second, third and fourth output ports, a respective one of said output ports being electrically coupled to a respective one of said antennas.

16. The antenna system of claim 15 wherein said antennas and said switch are secured to a base plate, and said output ports are connected to said respective antennas by first, second, third and fourth respective coaxial transmission lines.

17. The antenna system of claim 14 wherein said mast is further characterized by a first end disposed above said surface and to which said crossed-dipole structure is attached, and said center conductor element is further characterized by an elongated body and by first and second ends, said first end of said center conductor element terminating in a tip defining an angle with respect to said elongated body, said tip being electrically connected to said mast at said first end of said mast.

18. The antenna system of claim 17 wherein said crossed-dipole structure comprises first and second opposed long arm elements each having a length greater than one half the wavelength of the crossed-dipole resonant frequency, and first and second opposed short arm elements arranged at quadrature to the long arm elements, said short arm elements having a length less than said one half wavelength.

19. The antenna system of claim 18 further comprising first and second quarter-wavelength chokes defined in said first end of said mast, said chokes disposed opposite one another and intermediate respective ones of said long and short arm elements, said first choke disposed at a 90 degree spacing from said center conductor end tip.

20. The antenna system of claim 14 further comprising a coaxial connector extending below said surface and to which said center conductor and said hollow support mast are connected, said coaxial connector comprising a means for connecting an RF drive source to said antenna.

21. The antenna system of claim 14 wherein said crossed-dipole structure is arranged to radiate circularly polarized radiation.

* * * * *